US011811140B2

(12) United States Patent
Balakrishnan et al.

(10) Patent No.: US 11,811,140 B2
(45) Date of Patent: Nov. 7, 2023

(54) SURFACE FOR CONTROLLED RADIO FREQUENCY SIGNAL PROPAGATION

(71) Applicant: Massachusetts Institute of Technology, Cambridge, MA (US)

(72) Inventors: Hari Balakrishnan, Belmont, MA (US); Venkat Arun, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 131 days.

(21) Appl. No.: 16/862,983

(22) Filed: Apr. 30, 2020

(65) Prior Publication Data

US 2020/0350693 A1 Nov. 5, 2020

Related U.S. Application Data

(60) Provisional application No. 62/840,743, filed on Apr. 30, 2019.

(51) Int. Cl.

*H01Q 15/14* (2006.01)
*H01Q 17/00* (2006.01)
*H01Q 3/46* (2006.01)

(52) U.S. Cl.

CPC ..... *H01Q 15/148* (2013.01); *H01Q 3/46* (2013.01); *H01Q 17/007* (2013.01)

(58) Field of Classification Search

CPC ..... H01Q 15/148; H01Q 17/007; H01Q 3/46; H01Q 3/44; H01Q 1/007; H01Q 21/28;

(Continued)

(56) References Cited

U.S. PATENT DOCUMENTS 6,175,723 B1 * 1/2001 Rothwell, III ..... H01Q 3/24 342/359
2003/0228846 A1 * 12/2003 Berliner ..... H04B 17/23 455/67.11

(Continued)

OTHER PUBLICATIONS

Marco Di Renzo et al. Smart Radio Environments Empowered by AI Reconfigurable Meta-Surfaces: An Idea Whose Time Has Come. Mar. 21, 2019, [online], [retrieved on Jul. 16, 2022]. Retrieved from the Internet. <URL: https://arxiv.org/abs/1903.08925> (Year: 2019).*

(Continued)

*Primary Examiner* — Ricardo I Magallanes
*Assistant Examiner* — Yonchan J Kim
(74) *Attorney, Agent, or Firm* — Occhiuti & Rohlicek LLP

(57) ABSTRACT

A configurable radio frequency device includes a surface and a plurality of configurable radio frequency elements disposed on the surface. The radio frequency elements can be configured to absorb, reflect, or pass a radio transmission. A controller is configured to control the configuration of the surface by setting the state of the radio frequency elements. The controller also determines a deployment configuration for the surface by applying a series of test configurations to the surface and receiving a measurement of signal quality as measured by a receiver. The controller can then use these measurements to determine how to set the states of the radio frequency elements for the deployment configuration.

29 Claims, 7 Drawing Sheets

(58) Field of Classification Search
CPC ... H01Q 21/30; H01Q 15/0066; H01Q 15/008
See application file for complete search history.

(56) References Cited

U.S. PATENT DOCUMENTS

2004/0227667 A1* 11/2004 Sievenpiper ..... H01Q 13/20 343/745
2004/0263408 A1* 12/2004 Sievenpiper ..... H01Q 3/46 343/757
2018/0069295 A1* 3/2018 Han ..... H01Q 1/245
2019/0363763 A1* 11/2019 Frenger ..... H01Q 21/0037

OTHER PUBLICATIONS

Ke Chen et al. Geometric phase coded metasurface. Scientific Reports. Oct. 24, 2016, [online], [retrieved on Jul. 16, 2022]. Retrieved from the Internet. <URL: https://www.nature.com/articles/srep35968.pdf> (Year: 2016).*
A. Welkie, L. Shangguan, J. Gummeson, W. Hu, and K. Jamieson. Programmable radio environments for smart spaces. In HotNets, 2017.
Al-Naib and W. Withayachumnankul. Recent progress in terahertz metasurfaces. Journal of Infrared, Millimeter, and Terahertz Waves, 38(9):1067-1084, 2017.
C. Liaskos, A. Tsioliaridou, S. Nie, A. Pitsillides, S. Ioannidis, and I. Akyildiz. Modeling, simulating,a nd configuring programmable wireless environments for multi-usr multi-objective networking. arXiv preprint arXiv: 1912.11429, 2018.
C. Liaskos, S. Nie, A. Tsioliaridou, A. Pitsillides, S. Ioannidis, and I. Akyildiz. A new wireless communication paradigm through software-controlled metasurfaces. IEEE Communications Magazine, 56(9): 162-169, 2018.
C. Liaskos, S. Nie, A. Tsioliaridou, A. Pitsillides, S. Ioannidis, and I. Akyildiz. A novel communication paradigm for high capacity and security via programmable indoor wireless environments in next generation wireless systems. Ad Hoc Networks, 87:1-16, 2019.
C.A. Balanis. Arrays: Linear, planar, and circular. In Antenna theory: analysis and design, chapter 6. John wiley & sons, 2016.
D. Parker and D. C. Zimmermann. Phased Arrays—Part II: Implementations, Applications, and Future Trends. IEEE Trans. on Microwave Theory and Techniques, 50(3):688-698, 2002.
D. Parker and D.C. Zimmermann. Phased arrays—Part I: Theory and Architectures. IEEE Trans. on Microwave Theory and Techniques, 50(3):678-687, 2002.
H.-T. Chen, A. J. Taylor, and N. Yu. A review of metasurfaces: physics and applications. Reports on progress in physics, 79(7):076401, 2016.
J. Chan, C. Zheng, and X. Zhou, WiPrint: 3D Printing Your Wireless Coverage. In HotWireless, 2015.
J. Costantnie, Y. Tawk, S. E. Barbin, and C.G. Christodoulou. Reconfigurable antennas: Design and applications. Proceedings of the IEEE, 103(3):424-437, 1948.
J.S. McLean. A re-examination of the fundamental limits on the radiation q of electrically small antennas. IEEE Transactions on antennas and propagation, 44(5):672, 1996.
L. Subrt and P. Pechac. Intelligent walls as autonomous parts of smart indoor environments. IET Communications, 6 (8):1004-1010, 2012.
Li, Zhuqi, Yaxiong Xie, Longfei Shangguan, Rotman Ivan Zelaya, Jeremy Gummeson, Wenjun Hu, and Kyle Jamieson. "Towards programming the radio environment with large arrays of inexpensive antennas." In 16th {USENIX} Symposium on Networked Systems Design and Implementation ({NSDI} 19), pp. 285-300. 2019.
Liang, Ying-Chang, Ruizhe Long, Qianqian Zhang, Jie Chen, Hei Victor Cheng, and Huayan Guo. "Large intelligent surface/antennas (LISA): Making reflective radios smart." arXiv preprint arXiv:1906.06578 (2019).
M. Chen, M. Kim, A.M. Wong, and G.V. Eleftheriades. Huygens' metasurfaces from microwaves to optics: a review. Nanophotonics, 7(6): 1207-1231, 2018.
M. Di Renzo and J. Song. Reflection probability in wire-less networks with metasurface-coated environmental objects: An approach based on random spatial processes. arXiv preprint arXiv: 1901.01046, 2019.
N. Kaina, M. Dupré, G. Lerosey, and M. Fink. Shaping complex microwave fields in reverberating media with binary tunable metasurfaces. Scientific reports, 4(1):1-8, 2014.
P. del Hougne, M. Fink, and G. Lerosey. Optimally diverse communication channels in disordered environments with tuned randomness. Nature Electronics, 2(1):36-41, 2019.
P. Genevet and F. Capasso. Holographic optical metasurfaces: a review of current progress. Reports on Progress in Physics, 78(2):024401, 2015.
P. Nayeri, F. Yang, and A.Z. Elsherbeni. Beam-scanning reflectarray antennas: A technical overview and state of the art. IEEE Antennas and Propagation Magazine, 57(4):32-47, 2015.
P.F. McManamon, P.J. Bos, M.J. Escuti, J. Heikenfeld, S. Serati, H. Xie, and E.A. Watson. A review of phased array steering for narrow-band electrooptical systems. Proceedings of the IEEE, 97(6): 1078-1096, 2009.
R.B. Waterhouse, S. Targonski, and D. Kokotoff. Design and performance of small printed antennas. IEEE Transactions on Antennas and Propagation, 46(11):1629-1633, 1998.
Welkie, Allen, Longfei Shangguan, Jeremy Gummeson, Wenjun Hu, and Kyle Jamieson. "Programmable radio environments for smart spaces." In Proceedings of the 16th ACM Workshop on Hot Topics in Networks, pp. 36-42. 2017.
X. Tan, Z. Sun, J.M. Jornet, and D. Pados. Increasing indoor spectrum sharing capacity using smart reflect-array. In 2016 IEEE International Conference on Communications (ICC), pp. 1-6, IEEE, 2016.
X. Xiong, J. Chan, E. Yu, N. Kumari, A. Sani, C. Zheng, and X. Zhou. Customizing indoor wireless coverage via 3d-fabricated reflectors. In 4th ACM International Conference on Systems for Energy-Efficient Built Environments, 2017.
Y.-X. Ren. R.-D. Lu, and L. Gong. Tailoring light with a digital micromirror device. Annalen der physik, 527 (7-8):447-470, 2015.
Z. Li, Y. Xie, L. Shangguan, R. I. Zelaya, J. Gummeson, W. Hu, and K. Jamieson. Towards programming the radio environment with large arrays of inexpensive antennas. In NSDI, 2019.
Emil Bjornson et al. Massive MIMO is a Reality—What is Next? Five Promising Research Directions for Antenna Arrays?, Arxiv.org, Cornell University Library, 201 Olin Library Cornell University Ithaca, NY 14853, Feb. 11, 2019 (Dec. 11, 2019), XP081031467.
Marco Di Renzo et al. "Smart Radio Environments Empowered by AI Reconfigurable Meta-Surfaces: An Idea Whose Time Has Come," Arxiv.org, Cornell University Library, 201 Olin Library Cornell University Ithaca, NY 14853, Mar. 21, 2019 (Mar. 21, 2019), XP081156198, p. 8-10, p. 13-14, figures 3, 5, 7.
Hum, Sean Victor, and Julien Perruisseau-Carrier. "Reconfigurable reflectarrays and array lenses for dynamic antenna beam control: A review." IEEE Transactions on Antennas and Propagation 62, No. 1 (2013): 183-198.
Di Renzo, Marco, Alessio Zappone, Merouane Debbah, Mohamed-Slim Alouini, Chau Yuen, Julien de Rosny, and Sergei Tretyakov. "Smart radio environments empowered by reconfigurable intelligent surfaces: How it works, state of research, and road ahead." arXiv preprint arXiv:2004.09352 (2020).
International Search Report dated Jul. 21, 2020 in PCT Application No. PCT/US2020/030650.

* cited by examiner

SURFACE FOR CONTROLLED RADIO FREQUENCY SIGNAL PROPAGATION

CROSS-REFERENCES TO RELATED APPLICATIONS

This application claims the benefit of U.S. Provisional Application No. 62/840,743 filed Apr. 30, 2019, which is incorporated by reference.

BACKGROUND OF THE INVENTION

This invention relates to radio frequency ("RF") signals and, more particularly, to control of RF signal propagation in an environment.

Many radio systems use directional or sectorized antennas and beamforming to improve the throughput or range of a wireless communication link. Beamforming ensures that a larger fraction of transmitted energy reaches the intended device or reduces unintended interference of a signal transmitted from the device. Generally, the larger an antenna array, the more precisely an antenna pattern can be localized on a target device.

However, there are many practical challenges to making radio systems with large antenna arrays. First, devices such as internet of things (IoT) sensors and handhelds must be small. Second, connecting each antenna in an array to full-fledged radio transmit/receive circuitry can increase cost and power requirements. Third, large, bulky systems are hard to deploy, even in infrastructure base-stations or access points.

Interference can disrupt the transmission and reception of an RF signal. Walls, windows, corners, and objects in a room can disrupt the signal or produce wave patterns that weaken the signal before it is received. Outdoor transmissions are also subject to such interference from trees, buildings, and other structures. Additionally, many wireless transmitters and receivers are battery powered or have low-power transmitters. These include cell phones, appliances or other Internet of Things ("IoT") devices, and the like. Also, as the frequency of transmissions from hand-held devices continues to increase, the signals may be more susceptible to interference from the environment.

SUMMARY OF THE INVENTION

In a general aspect, an approach to improving radio transmission between devices in an environment controls radio frequency propagation in the environment by controlling radio frequency properties of a surface in the environment (e.g., in an indoor one-room or multi-room environment). In such an approach, reflective (and/or transmissive or absorptive) characteristics at different locations on a surface are controlled to, in the aggregate (i.e., by a combination of multiple paths), control transmission characteristics between devices in the environment. By way of optical analogy, the surface functions as a controlled mirror or lens that focuses signals passing between, to, or from devices in the environment. When associated with a particular device (i.e., a transmitter and/or receiver), a combination of the device's primary antenna (which may itself be an array), and the controlled surface together can essentially operate as a controlled antenna array; but it should be understood that the controlled surface is not necessarily associated with or directly coupled to a primary device, but rather can operate independently of a particular transmitter or receiver.

Particular embodiments of this approach may use an array of thin elements (also referred to as "radio frequency (RF) elements") that are disposed on surfaces in an environment, such as on walls, ceilings, or windows of an indoor environment, or on the sides of buildings in an outdoor environment.

In some embodiments, a surface can be configured to propagate an RF signal as it passes through the environment to increase signal quality at a receiver, so that a weak or error-prone signal can be received. For example, a surface may have a plurality of individually configurable elements that can be configured to reflect from, absorb in, or allow the RF signal to pass through the element, with the configuration of the elements being selected to result in improved reception. For example, each element may have at least two conductive sections and at least one RF switch coupled between adjacent conductor sections. Opening and closing the switch can change the state of the configurable element so that it either reflects or passes the RF signal.

A controller, such as a processor or circuit, can control the switches to set the state of the configurable elements. The controller may also determine and set a deployment configuration of the surface that improves reception of the RF transmission. In some embodiments, the controller can apply a series of test configurations to the surface and measure (or receive a measurement of) the signal quality, such as signal strength, noise, bit error rate, or the like. Using the signal quality measurements, the controller can then determine a state for each configurable element and define a deployment configuration that includes those states. The controller can then apply the deployment configuration to the surface to improve reception of the RF signal.

The examples provided below are intended to illustrate the concepts of a surface that can propagate or enhance an RF transmission, and methods of configuring that surface. However, many alternatives can be used.

Aspects of the devices and methods may include one or more of the following features. For example, each element may have an on state that reflects an RF signal and an off state that passes an RF signal. The deployment state may be defined by a set of element states that enhance reception of the RF signal. In other examples, the elements may have multiple states that include reflection, absorption, or passing of an RF signal, and/or intermediate state that are a combination of reflection, absorption, and passing. In general, the elements may be "passive" in the sense that they do not (individually and/or in aggregate) add RF energy. For example, with the average RF power emitted from an element being less than or equal to the average RF energy impinging on the element. There may be active (powered) electronic components on such a passive element, for example, controlling an RF switch, with power for such components being supplied by a battery, a wired power connection, or via wireless power delivery.

The switchable radio frequency elements may include at least one radio frequency switch. In this case, the state of the element can be applied by switching the switches on and off.

The controller may measure (or receive a measurement) of the signal quality of the RF signal at the receiver. The controller can then use such measurements to determine a deployment configuration of the surface. The deployment configuration may include a set of states for some or all the elements of the surface that enhances reception of the RF signal based on the characterized measurement of signal quality.

The configurable elements may include conductors and switches to set the states. The conductors may have dimensions chosen to reflect or pass RF transmissions of a predetermined frequency or frequency range. The switches can couple the conductors together to change the state of the configurable elements.

Other features and advantages of the invention are apparent from the following description, and from the claims.

BRIEF DESCRIPTION OF THE DRAWINGS

Like reference numbers in the figures denote like elements.

DETAILED DESCRIPTION

1 Overview

Figure 1A:
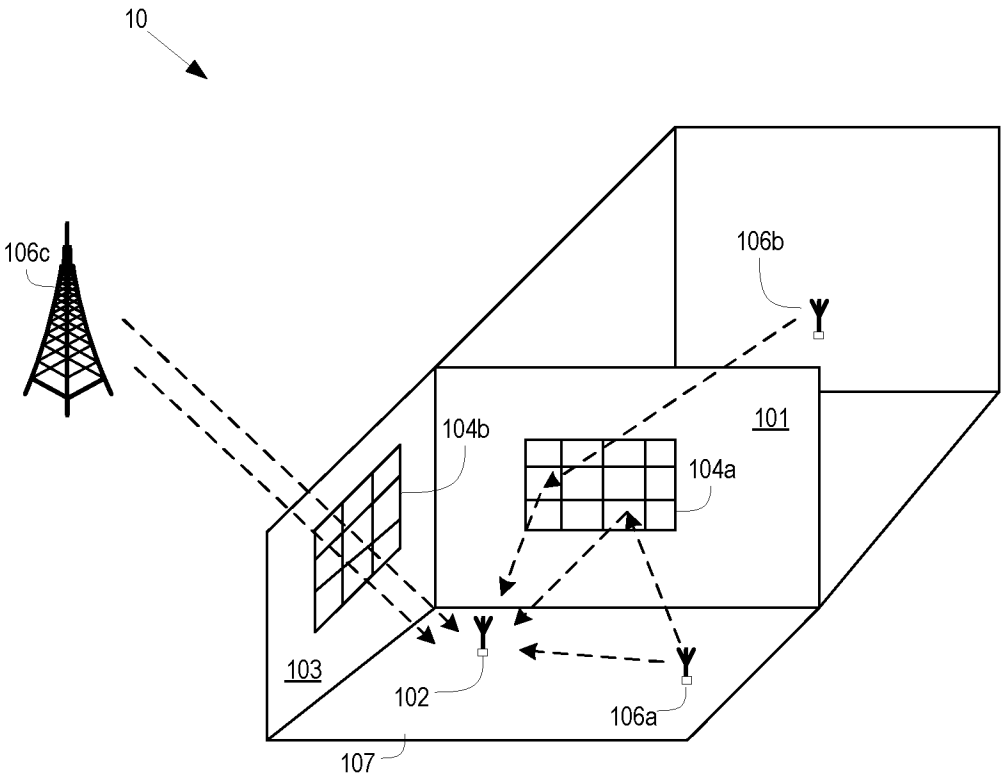
FIG. 1A is a perspective view of an environment with configurable surfaces for propagating RF signals.

Referring to FIG. 1A, an environment 10 is set up with surfaces 104*a* and 104*b* to propagate RF signals between transmitters 106*a-c* and a receiver 102. Each surface has many separate elements that can selectively configured to reflect or to pass RF signals that impinge on the particular elements to enhance reception of the RF signals at receiver 102.

The surfaces 104*a-b* can be deployed in various ways to propagate signals through both indoor and outdoor environments. For example, surface 104*a* may be installed on an interior wall or a window to reflect signals from transmitter 106*a* to receiver 102. Surface 104*a* may also be configured to allow RF signals from transmitter 106*b* to pass through the surface 104*a* to be received by receiver 102.

Surface 104*b* can be installed on an exterior wall or window to enhance transmission of RF signals by transmitter 106*c* (e.g., on an outside radio tower) to receiver 102, which may be located inside a home or building. Although not shown, surface 104*b* may also be configured to reflect RF transmissions from an outside transmitter 106*c* to another receiver that is also located outside.

RF signals can take multiple complex and convoluted paths ("multipath") through the environment 10 before they are received. This can lead to poor reception due to unintended interference (e.g., destructive interference) between paths. The controlled surface can be configured to enhance a transmission by creating reflected paths or paths that pass via the surfaces 104*a* and/or 104*b* that constructively combine to form the received signal at the receiver 102.

Figure 1B:
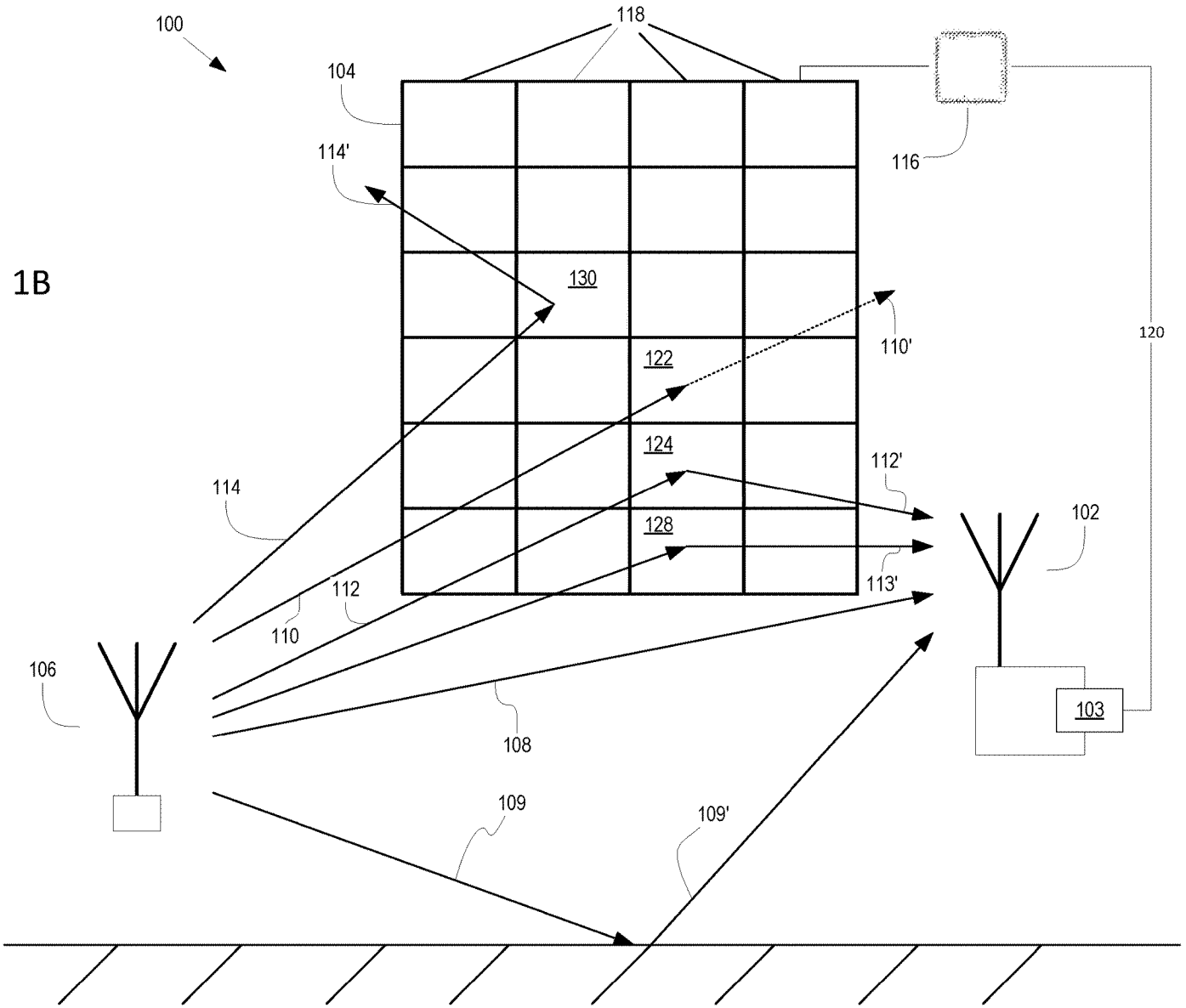
FIG. 1B is a block diagram of a surface with configurable elements for propagating RF signals, as well as an RF transmitter and RF receiver.

Referring to FIG. 1B, a system 100 for propagating RF signals includes a surface 104 including multiple elements 118 that can be configured to affect propagation of signals via the elements. In particular, the configuration of an element can affect whether signals reflect or pass through that element. The system also includes a controller 116 for controlling and configuring the configurable elements 118 of the surface 104. In various embodiments, the surface 104 includes many (e.g. thousands) of elements, few (e.g. 1-100) elements 118, or any number of elements 118 that can be controlled by the controller 116. As an example, the surface may be 6 $m^2$ with 3200 elements (i.e., about 7.2 $cm^2$ each, although in alternative embodiments the elements may be larger or smaller and may be spaced apart from each other at predefined or varying distances, or may be absent from some areas of the surface).

The surface 104 is shown in FIG. 1B as a planar surface (i.e., all the elements are mounted in the same plane) for ease of illustration. However, in various embodiments, there is no requirement that the surface be planar. The surface may have any desirable shape to fit into the environment. For example, the surface 104 may form a planar array as shown, or have a corner so it can be placed around the corner of a wall, a curve so it can be placed around a curved object or around a sphere, or a more complex shape so it can be place around or on a complex object such as a lampshade or other sculpture. In various embodiments, the surface 104 may have a rigid substrate (such as a sheet of plastic or other material) or a flexible substrate (such as a fabric or other material) so that it can be placed as desired in the environment.

Although the surface 104 is shown with adjacent configurable elements 118 that share edges, this is not required. The configurable elements may be separated from each other or even dispersed about the environment. For example, in an embodiment, if surface 104 is placed in a room, all the configurable elements 118 may be adjacent as shown in FIG. 1A. In other embodiments, some or all of the elements 118 may be placed together on one wall, other elements 118 may be placed on a different wall or window, and other elements may be placed on any other surface in the room, or even in a different room or area.

In the embodiment shown in FIG. 1B, each element 118 may be configurable into one of two states: an "on" state that reflects the RF signal, as shown by the a reflected path 114' of an impinging path of a signal 114 (i.e., illustrated vectors 114 and 114' represent physical trajectories in three dimensional space), and an "off" state that allows the RF signal to pass through, as shown by RF signal path 110 passing through configurable element 122 as signal 110' (i.e., not reflected). In other embodiments, the configurable elements may also operate to absorb signals, change the phase of the signals, change the polarization of the signals, and/or partially reflect, absorb, change polarization, or pass the signals through. In other aspects, each element may be configurable into one of multiple states, where each state has a particular reflection coefficient (e.g. magnitude and/or phase), absorption coefficient, and/or pass-through coefficient to produce predefined levels of reflection, absorption, and/or pass-through of the RF signal.

The surface 104 may be configured to propagate the RF signals from transmitter 106 so that they can be more effectively received by an RF receiver 102. The RF receiver 102 may be any type of device that can receive an RF signal including, but not limited to, an appliance, a cellular phone, a wireless networking device, and the like. The receiver 102 includes a signal monitor 103 that has access to signals and/or characteristics of signals received at the receiver 102 from the transmitter 106. For example, the signal monitor 103 is part of or coupled to the received signal processing path of the receiver 102. In particular, the signal monitor 103 can measure or receive characteristics of the received signal that represent signal quality. These characteristics include, but are not limited to, received signal strength (RSSI) measurements, bit error rate measurements, jitter measurements, noise measurements, phase measurements, or other characteristics that indicate (e.g., are correlated with or otherwise represent) signal quality of the transmission as received by the receiver 102 and/or the signal monitor 103.

As discussed later in this document, although shown as part of receiver 102 in FIG. 1B, in other examples, the signal monitor 103 may be separate from receiver 102. For example, it may be part of or co-located with controller 116, or it may be placed at another location within the environment.

The receiver 102 may receive RF signals directly from the environment (i.e., directly from the transmitter 106 as indicated by a signal path 108), and/or receive signals that are reflected from elements of the environment such as wall, floors, or other objects, as indicated by a signal path 109-109' reflected from a floor surface. But the receiver 102 may also receive RF signals that bounce off or pass through the surface 104, such as signals via paths 112' and 113'.

The signal monitor 103 is communicatively coupled to the controller 116 via a wired or wireless link. Thus, the signal monitor 103 can provide the measured characteristic of the received signal to the controller 116 as a feedback signal 120. For example, the feedback signal 120 may provide a measurement of signal strength, bit error rate, jitter, signal-to-noise ratio, or any characteristic or combination of characteristics that can be used to characterize the quality of the received signal.

In operation, the controller 116 configures the surface 104 by configuring one or more of the elements 118 before or between RF transmissions sent by the transmitter 106. The signal monitor 103 then measures at least one characteristic of the RF signal and provides feedback signal 120 (which includes the measured characteristic) to the controller 116. The controller 116 then reconfigures the surface 104 by changing the states of one or more of the elements 118. Then, upon a subsequent transmission, the signal monitor 103 again measures the characteristic of the RF signal and feeds the measurement back to the controller 116. The controller 116 may repeat this process multiple times, then determine a deployment configuration (i.e. a set of states of the elements 118) that improves reception characteristics of the RF signal at the receiver 102, and apply the deployment configuration to the surface 104 to propagate the transmission of the RF signal from transmitter 106 to receiver 102. An example of this type of process is described in additional detail below.

Figure 2A:
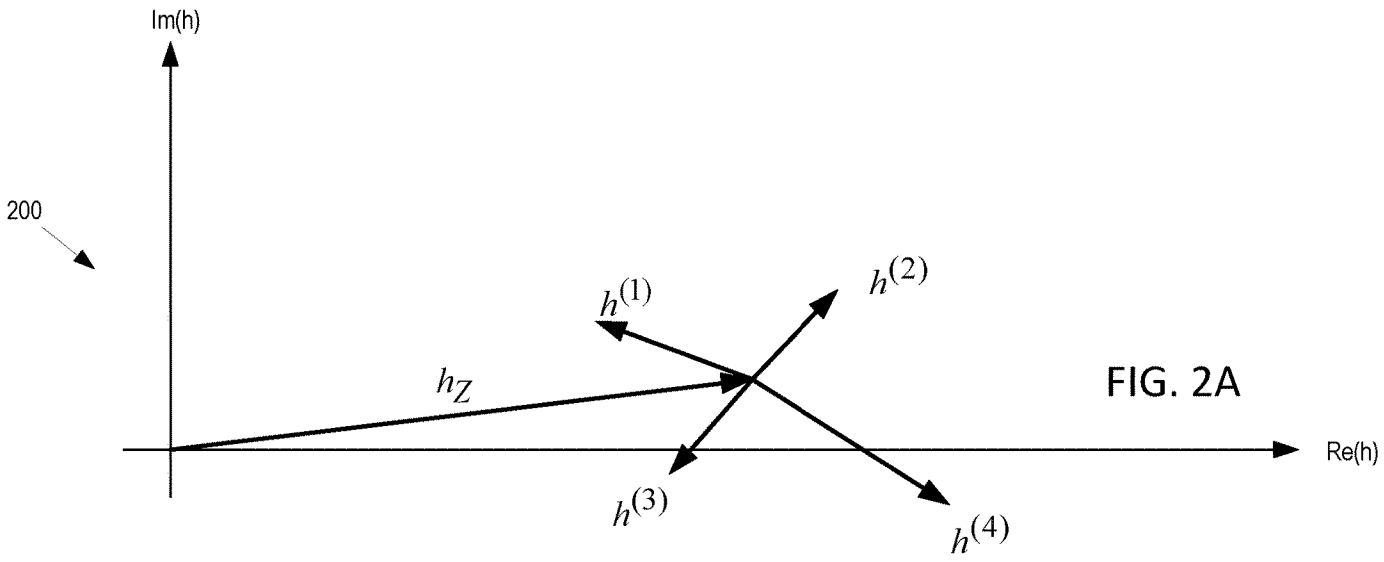
FIG. 2A and FIG. 2B are diagrams of RF channel vectors.
Figure 2B:
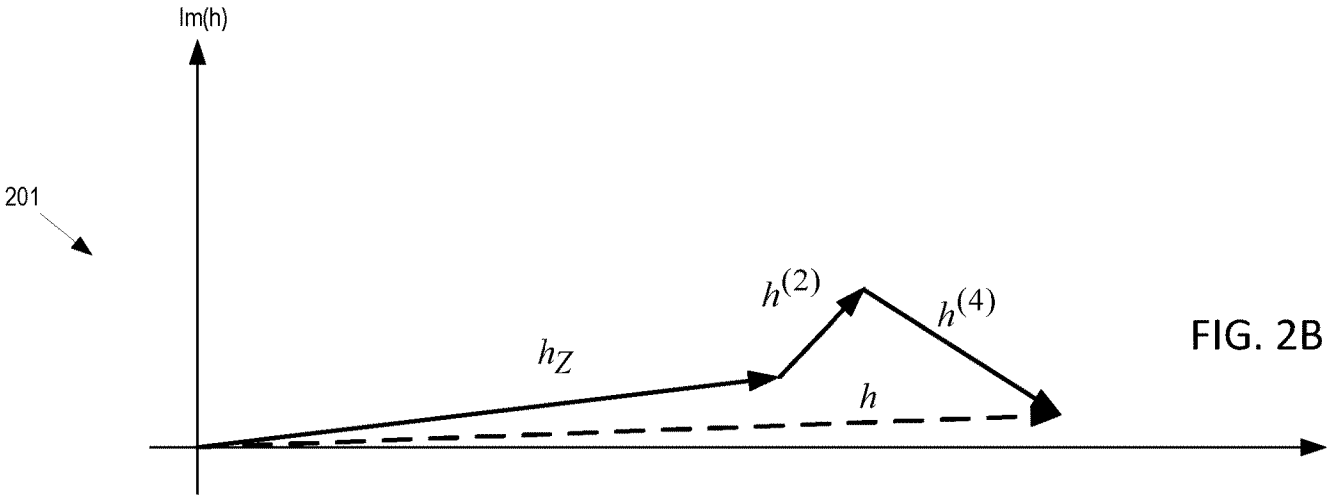

Referring to FIG. 2A and FIG. 2B, complex vector diagrams 200 and 201 provide vector illustrations of the magnitude and phase of the RF channels corresponding to various signal paths shown in FIG. 1B, where horizontal represents the real axis and vertical represents the imaginary axis of the complex channel between devices (i.e., representing magnitude and phase of the channel). In any environment, there are multiple paths for an RF transmission to take to a receiver. Each path can be represented by a complex vector representing the component of the overall channel associated with that path. The net channel is the complex sum of the channel components from the transmitter to the receiver, represented by h, $$h = h_z + \sum_{i:\ element\ i\ on} h^{(i)} = h_z + \sum_{i=1}^{N} h^{(i)} b^{(i)} \tag{1}$$

where $b^{(i)}=0$ if element i is "off" and $b^{(i)}=1$ if it is "on," $h_Z$ denotes the combined complex channel when all the elements are "off," and $h^{(i)}$ denotes the effect of turning on element i (i.e., the incremental channel resulting from turning element i on). In the case that the surface acts as a "mirror" and that only "on" elements contribute to the overall channel, $h_Z$ is the combined channel of all the paths that are not affected by the surface 104 where $h_Z \cong c_E$, i.e., the one or more unmodified paths that are direct paths and fixed reflecting paths between the transmitter 106 and the receiver 102. For example, in vector diagram 200 for a simplified example with N=4 elements, the channel $h_Z$ and the incremental channels $h^{(i)}$ that can be added to $h_Z$ are illustrated. In general, to maximize the amplitude of the overall channel h, only incremental channels that point within ±90° of the same direction (phase) as $h_Z$ constructively increase the channel magnitude, while the other channels reduce the channel magnitude. Therefore, referring to FIG. 2B, a selection of elements 2 and 4 (i.e., leaving elements 1 and 3 "off") yields this largest magnitude channel $h=h_Z+h^{(2)}+h^{(4)}$. As described below, one role of the controller is to select those elements to turn on to achieve such a greatest overall channel magnitude.

2 Surface Configurations

When all the elements are turned off, as introduced above, the channel is $h_Z$. One approach to selecting the elements to turn on is, one by one for each element i to measure the effect of turning on just element i by comparing the channel (i.e., is magnitude or a measurement that relates to the magnitude) between when it is on and when it is off. If the channel improves when it is on (e.g., because it constructive adds as illustrated in FIGS. 2A-B), then that element is kept on. However, in many implementations, this change from only one element is too feeble to measure, and one cannot statistically tell the difference between an element being on or off, even with hundreds of samples. That is, if the incremental channels have average (expected) amplitude $h \ll |h_Z|$.

One or more embodiments take advantage of a "channel boosting" feature in which even if the effect of turning one element on cannot be easily detected, turning on M elements results in a channel increment that has an expected amplitude that may scale approximately as $\sqrt{M}$ as compared to one channel (i.e., it is of order $\bar{h}\sqrt{M}$). Therefore, the effect of turning on a subset of M elements of the total available N elements may be more easily measured or detected, and the combined effect can be determined to be constructive or destructive. To determine which specific elements to turn on or off, very generally, the controller uses different subsets of elements, and combines the measured effects corresponding to the different subsets to select the individual element to include in a configuration that is optimal or close to optimal. As described below, one such procedure uses a series of K different random selections of exactly or approximately M=N/2 elements.

In this embodiment, the controller 116 determines a deployment configuration by applying a series of test configurations, receiving a measurement of signal quality of the aggregate RF signal that is received by the receiver 102, and creating a deployment configuration by choosing states for the elements 118 based on the signal quality measurements of the measurements of the aggregate signal received by receiver 102.

Figure 3A:
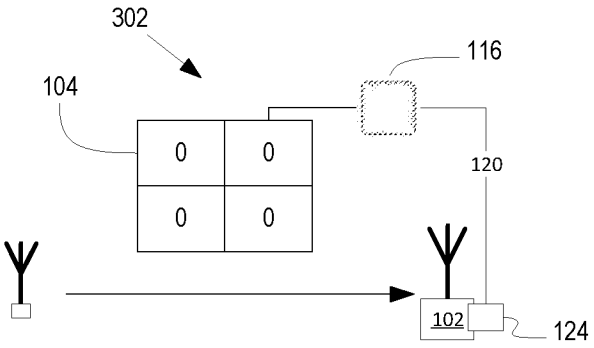
FIG. 3A, FIG. 3B, FIG. 3C, and FIG. 3D are block diagrams of surfaces with configurable elements shown with various configurations and associated diagrams of RF channel vectors.
Figure 3A:
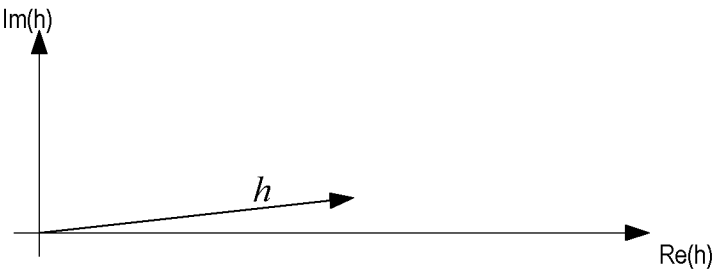

FIGS. 3A-3D illustrate examples of test configurations applied to the surface 104 in a simplified N=4 element example corresponding to FIG. 2A, by the controller 116 and the resulting RF channel h measured by the receiver 102. In this example, the controller 116 may randomly turn the elements 118 on and off, so each test configuration consists of a random set of element states. FIG. 3A corresponds to a configuration in which all the elements are off, and FIGS. 3B-D correspond to selections of different subset of M=2 elements being on.

In FIGS. 3A-3D. The elements 118 are shown with a "1" to indicate the element is in an "on" state and reflecting the RF signal, and a "0" to indicate the element is in an "off" state and passing the RF signal. This example assumes that the receiver 102 is positioned so that it can receive reflected RF signals but not RF signals that pass through surface 104. Of course, in a real-world example, receiver 102 may be positioned so that it receives signals that are reflected by surface 104, that pass through surface 104, or both, with the combination to the overall channel depending on the configuration of the element.

In FIG. 3A, the controller 116 applies a test configuration 302 to the surface 104 where all the elements 118 are all set to pass (i.e., not reflect) the RF signals. As a result, the surface 104 does not reflect any RF signals to the receiver 102 and the signal received by the receiver 102 is simply the transmission through the environment $h_Z$. The receiver 102 then measures one or more characteristics of the signal h and feeds the measurements back to controller 116 as feedback signal 120.

Figure 3B:
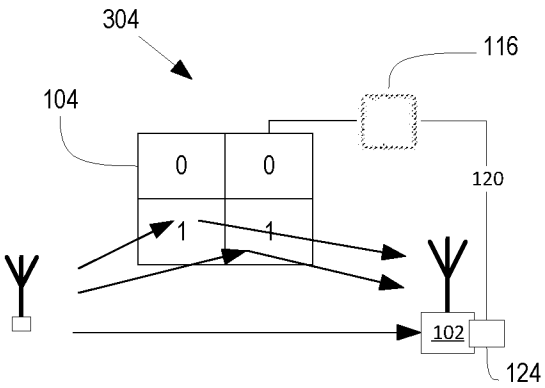
Figure 3B:
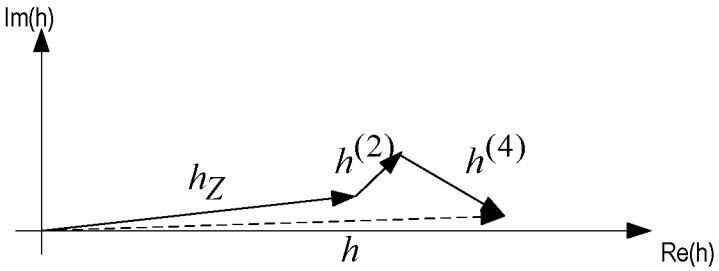

In FIG. 3B, the controller 116 applies another test configuration 304 to the surface 104. In this configuration 304, the top two elements (1 and 3) 118 are randomly configured to pass the RF signals and the bottom two elements (2 and 4) 118 are configured to reflect the RF signals. As a result, as shown in the channel diagram 306 the resulting channel h is $h_Z+h^{(2)}+h^{(4)}$. Again, the receiver 102 measures one or more signal characteristics of the received signal h and feeds the measurements back to the controller 116 as feedback signal 120.

Figure 3C:
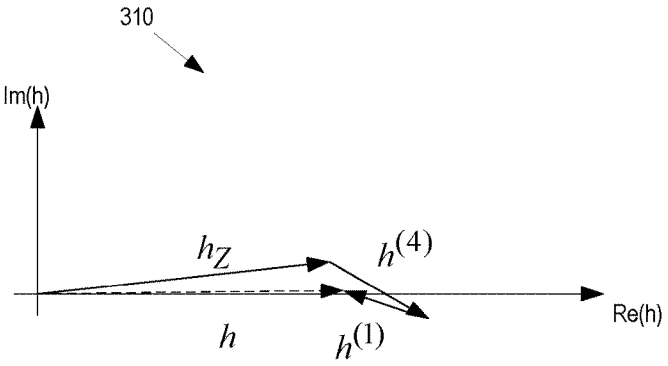
Figure 3C:
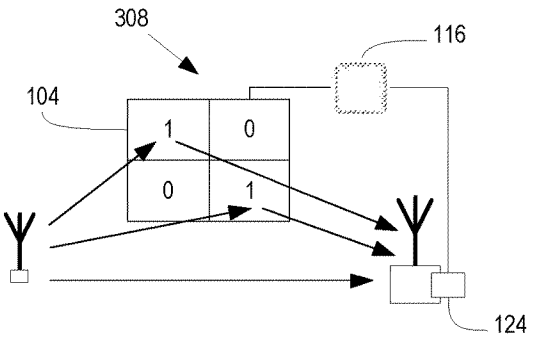

In FIG. 3C, the controller 116 applies a test configuration 308 to the surface 104 where the top-left and bottom-right elements (1 and 4) are configured to reflect the RF signal and the other elements are configured to pass the RF signal. As a result, as shown in the channel diagram 310 $h=h_Z+h^{(1)}+h^{(4)}$. Again, the receiver 102 measures one or more signal characteristics of the received signal h and feeds the measurements back to the controller 116 as feedback signal 120.

Figure 3D:
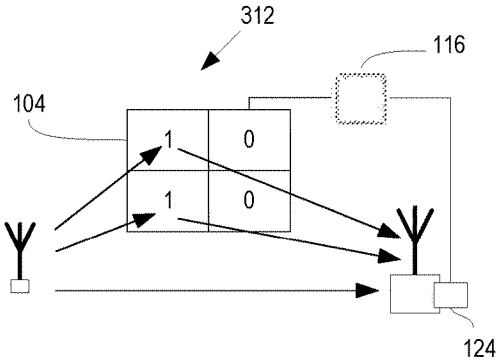
Figure 3D:
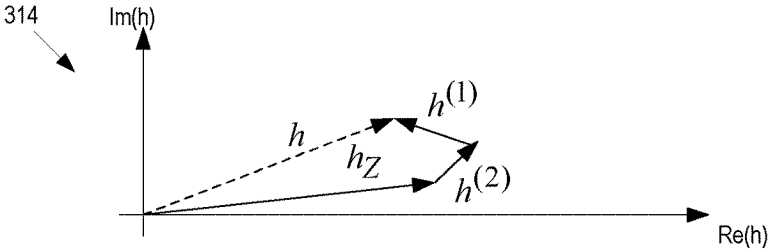

In FIG. 3D, the controller 116 applies a fourth test configuration 312 to the surface 104 where the top-left and bottom-left elements (1 and 2) are configured to reflect the RF signal and the other elements are configured to pass-through the RF signal. As a result, as shown in channel diagram 314 $h=h_Z+h^{(1)}+h^{(2)}$. Again, the receiver 102 measures on or more signal characteristics of the received signal j h and feeds the measurements back to the controller 116 as feedback signal 120.

After applying the series of test configurations, the controller 116 uses the measurement results provided by receiver 102 to determine a deployment configuration by algorithmically determining which states to apply to the individual elements 118. The deployment state for the surface includes the set of deployment states for the elements. The controller 116 may then apply the deployment configuration to surface 104 to improve reception of the RF signal by receiver 102. The deployment state may be maintained for some or all of the time that RF transmitter 106 subsequently sends transmissions to RF receiver 102. Additionally or alternatively, the controller 112 may continuously or periodically test different configurations and apply a deployment configuration to enhance the received signal.

In this example, the surface 104 is configured with four different configurations 302, 304, 308, and 312. However, the controller 116 may repeat the test process any number of times and receive multiple measurements of the received signal h to determine a deployment configuration.

3 Deployment Configuration

Based on the measurements received from the receiver 102, the controller 116 may determine a deployment configuration for the surface 104 that improves reception of the signal h received at the receiver 102. Each reflected channel from individual elements 118 may be small, but the summation of the reflections can have a significant effect. As noted above, if M random elements are turned on, the expected magnitude the incremental channel is $\sqrt{M}$ times the expected magnitude of the incremental channel of any one element, which is easier to detect than the effect that may occur if one element is changed.

As noted above, the receiver 102 may perform various measurements of the RF signal, and any of these measurements (or any combination of these measurements) can be used to determine a deployment configuration that boosts the RF signal. For the purpose of this example, signal strength (RSSI) will be used to illustrate how the deployment configuration is determined.

Figure 4:
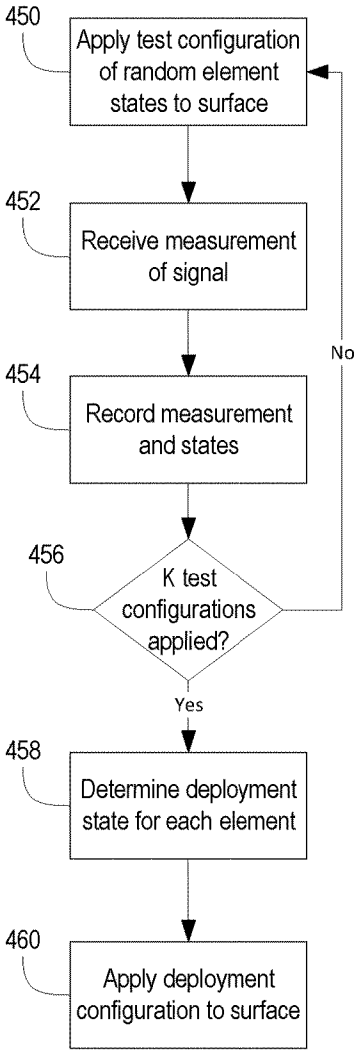
FIG. 4 is a flowchart of a process for determining a deployment configuration of a surface for RF signal propagation.

Referring to FIG. 4, in various embodiments, the state of each element 118 (i.e., the state of reflection or pass-through) for a given test configuration is determined randomly. Once a random state is determined for each element, the controller 116 applies the random states to each element 118 as a test configuration (block 450), for example, turning each element on with probability 0.5 or selecting a random subset of half the elements to turn on. While (or after) the test configuration is applied, the controller 116 receives an RSSI measurement of the signal from the receiver 102 (block 452). The controller 116 then records the test configuration (i.e., records the state of each element 118) and the resulting RSSI measurement (block 454). After a predetermined or calculated number N of test configurations have been applied (block 456), the controller 116 can then determine a deployment configuration for the surface 104 by determining a deployment state for each element (block 458). The controller then applies the deployment configuration to the surface to propagate signal transmission from transmitter 106 to receiver 102 (block 460).

The flowchart in FIG. 4 is provided as an example of a process to configure the surface 104. However, variations of the process shown could also be used.

In this example, controller 116 may perform a voting algorithm to determine the state of each element 118 that should be included in the deployment configuration. The following pseudo-code provides an example of a such a voting algorithm:

```
procedure MAJORITYVOTE ([b1,...,bK], RSSI)
// RSSI[j] gives the measured RSSI-ratio for state bj
b⊥ ← blank-vector // The final optimized state
m ← MEDIAN (RSSI)
for i:=0 to N do
  VoteOn ←0; VoteOff ← 0
  for j:=0 to K do
    if
      (b(i)j ==1 and RSSI [j] > m) or
      (b(i)j ==0 and RSSI [j] < m) then
```

-continued

```
        VoteOn ←VoteOn+1
    else
        VoteOff ←VoteOff+1
  b^(i)_⊥ ← (VoteOn>VoteOff)
return b_⊥
```

Increasing the number (K) of test configurations that are applied to surface 104 and measured by receiver 102 can improve the performance of the voting algorithm above. In various embodiments, the number of test configurations used to determine a deployment configuration may be in the 10's, 100's, or 1000's of test configurations.

4 Configurable Elements

Figure 5:
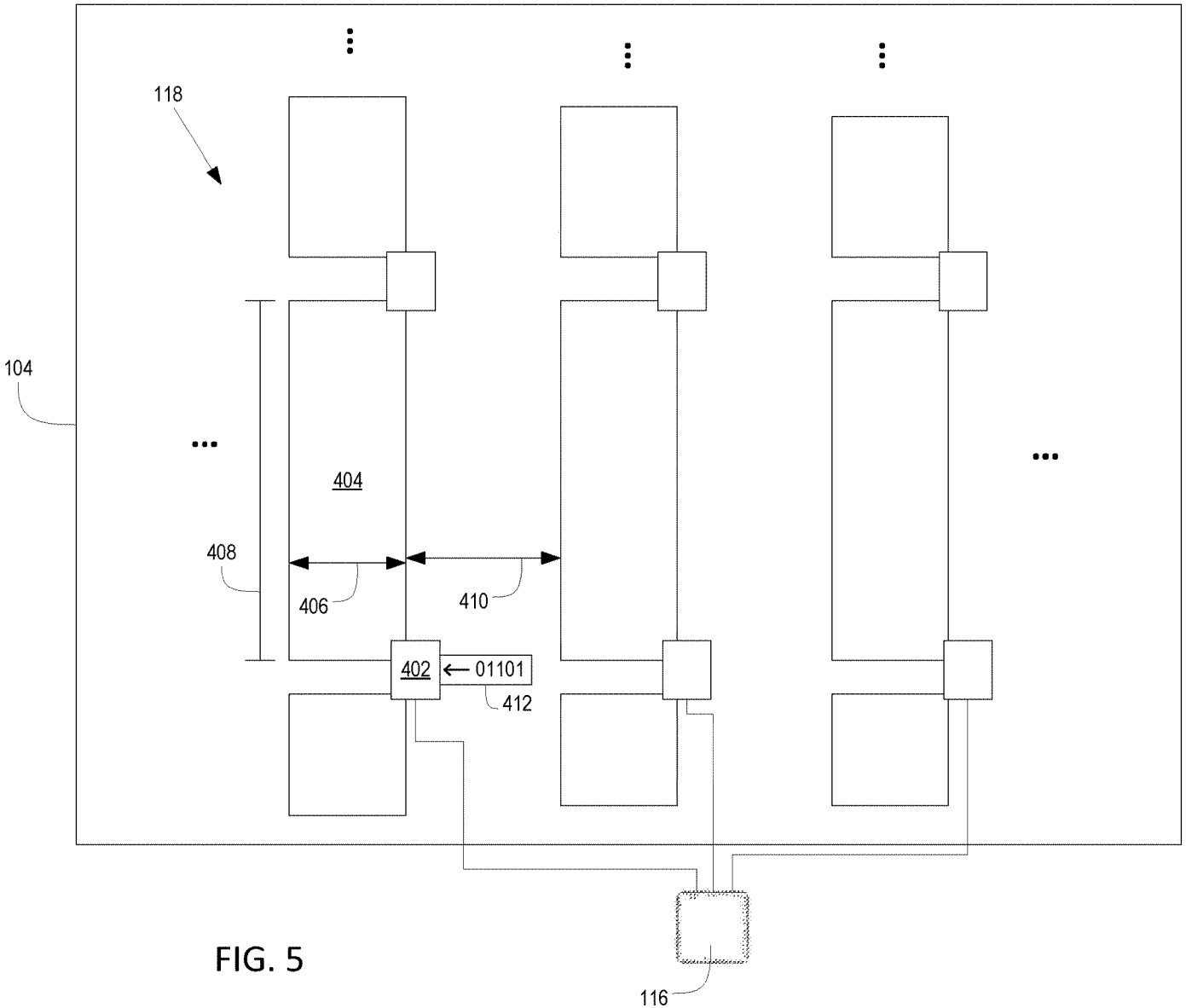
FIG. 5 is a block diagram of configurable elements.

Referring to FIG. 5, the surface 104 includes multiple configurable elements 118 that can be configured to reflect or pass RF signals. Each configurable element 118 may include two or more conductors 404 that can be electrically coupled together by one or more RF switches 402, e.g., RF transistors, bias controlled diodes, etc.

The conductors 404 may have a rectangular shape and may be formed from a thin metal material, such as a copper or aluminum foil. In some aspects, the conductors 404 may also be printed on a substrate (not shown) or directly onto surface 104. The conductors 404 may be manufactured to be thick enough so that they are rigid, or thin enough so they are flexible and can form to a surface, depending on how they are to be deployed. The conductors 404 may also be formed into other shapes besides rectangles.

The dimensions of each conductor 404 are chosen so that connecting the conductors 404 via the RF switches 402 will cause the conductors to reflect or pass an RF signal at an expected frequency. For example, the dimensions may be based on the wavelength of the transmission. In one example, the width 406 may be $\lambda/10$ and the height may be $\lambda/4$, where $\lambda$ is the expected wavelength of the transmission. In this example, the gap 410 between elements 118 may also be at least $\lambda/10$. In other words, the elements 118 may be separated from each other in any direction by at least $\lambda/10$. As another example, the distance 410 between elements may be $\lambda/4$ or less. These dimensions may allow element 118 to act like a half-dipole antenna. Also, the RF switches 410 may be spaced apart from each other at a distance of about $\lambda/2$.

When the RF switch 402 is closed, the height 408 of the conductor 404 is effectively increased so that it can reflect the RF signal, acting like an RF mirror. When the RF switch 404 is open, the conductor 404 may be effectively transparent to the RF signal so that the RF signal passes through the element 118.

In various embodiments, the element 118 and the associated conductors do not contain any dielectric material and may simply consist of the conductors and switch. For instance, the element 118 can have a single conductive layer, without a second layer (e.g., a ground plane and/or any dielectric layer). In other embodiments, a dielectric may be included to alter or affect the RF reflection.

This example illustrates an element 118 that has an on state and an off state for reflecting or passing an RF signal of a particular frequency or frequency band. However, the element 118 can be reconfigured by, for example, modifying the conductors, adding or removing conductors, and reconfiguring and/or adding switches between the conductors so that the element 118 has multiple states that can reflect, pass, or absorb RF signals.

The controller 116 may communicate with the switch 402 via a wireless or wired link. In various embodiments, a serial bus is used to address each switch 402 within surface 104. In other embodiments, especially if the number of elements 118 is large, multiple serial busses may be used to reduce the time necessary to switch many elements.

In this embodiment, the elements shown in FIG. 4 are aligned vertically. Thus, they may be most effective when used for vertically polarized radiation. However, the design can be generalized by including conductors 404 with various shapes and directions of alignment to affect transmissions of different polarizations.

Controller

The controller 116 may be a general processor or a custom circuit configured to perform the methods described above. In various embodiments, the controller 116 may include or communicate with RAM and/or ROM memory that includes software instructions for performing the methods described above. The software instructions may cause the processor to perform functions such as controlling the elements 118, applying test configurations to the surface 104, receiving measurement data from the receiver 102, determining a deployment configuration for the surface 104, and/or applying the deployment configuration to the surface 104, as well as any of the other functions mentioned or in the following sections.

6 Alternate Embodiments

In at least some embodiments described above, the controller has a wired connection to each of the elements, either directly or in a daisy-chained configuration. In an alternative, each element is powered and controlled wirelessly, like a passive RFID tag. The controller acts like a RFID controller that sets the state of each element. In such a setup, buildings could prefabricate their walls with the elements. Carpets and wallpapers could be sold with elements already embedded in them. Users can separately buy a controller to control and obtain the benefits of the elements already present in the environment.

In embodiments, the elements 118 may be have multiple configurable states (either continuously variable or from a discrete set). As noted above, the elements 118 may include reflective or pass-through states. However, the elements 118 may also be configurable into an absorptive state or intermediate states that provide intermediate levels of reflection, absorption, polarization, or passing of the RF signal. Referring to equation (1) above, in this example where the elements 118 are configurable with multiple states, the term $b^{(i)}$ could represent any complex number such that $|b^{(i)}|\leq 1$. This can be accomplished, for example, by including conductors of varying shapes, sizes, and orientations in the elements 118 that are coupled together in various arrangements by one or more controllable RF switches.

In some embodiments, all the elements 118 may be varied by the controller 116 when applying test or deployment configurations to the surface 104. In various other embodiments, only some of the elements 118 may be varied by controller 116. Thus, in these embodiments, the test and deployment configurations may include only a subset of the total number of elements of the surface 104. Also, while the process shown in FIG. 4 describes testing K test configurations then determining a deployment configuration, variations of this process may also be used. For example, after some number K<N test configurations have been applied, the controller 116 may determine a deployment state for some or all the elements and apply (e.g. fix) the state of those elements 118. After the state of these elements 118 has been fixed, the controller 116 can continue to apply test configurations to elements 118 that have not yet been fixed to determine deployment states for some or all of those elements 118.

In some examples, the controller 116 can apply a deployment configuration to the surface 104 as described above, then continue to test a subset of elements to improve the deployment configuration. For example, while a deployment configuration is active on the surface 104, the controller 116 can apply test configurations to half, a quarter, and eighth, or some other subset of the elements 118. Receiver 102 can then measure the RF signal it receives and feed the measurement back to the controller, which can then determine a deployment configuration for the subset of elements to further improve reception of the RF signal at the receiver 102.

As described above, the controller 116 may use a voting scheme to determine the state of individual elements in the deployment configuration. However, other schemes may be used. For example, to determine a deployment state for an element 118, the controller 116 could use a linear regression, a logistic regression, a machine learning algorithm, or any form of predictive analysis to determine a state of the element 118 that enhances reception of the RF signal.

In some aspects, the controller 116 may switch the state of each switch 402 directly, by issuing a command to turn on or off, for example. In other embodiments, element 118 may include a memory such as a shift register 412 (shown in FIG. 5) (e.g., a linear feedback shift register, LFSR) that outputs a predetermined set of states to be applied to element 118. The shift register 412 may contain a predetermined set of states that are known to the controller 116 such as a predetermined pattern or a pseudo-random series of states generated with a known seed. In this example, the controller 116 does not need to specify the state for the element 118, but rather can issue a command telling the element 118 to proceed to the next state. In some embodiments, the command from the controller 116 could be a simple command such as a clock signal, issued via a wired connection or broadcast via a wireless connection. Also, the command from the controller 116 may be distributed to some or all the shift registers in parallel (via a serial-to-parallel bus, for example) allowing the controller 116 to quickly issue the command to switch states to some or all the elements 118 without having to send a command to each element. The shift registers can then perform a shift in parallel (e.g. at about the same time) to switch the states of the elements 118. Alternatively, rather than receiving a command from the controller 116 to switch states, the element 118 may switch to the next state in the shift register 412 after a predetermined amount of time has passed.

As noted above, the states of the elements 118 in the test configurations may be set to a random state. In other embodiments, the states of the elements 118 in each test configuration may be set according to a predetermined sequence or pattern.

The channel boosting approach described above does not necessarily use random subsets. For example, a systematic selection of subsets (e.g., $K=\log_2 N$ different subsets of $M=N/2$ elements) may be used. Furthermore, rather than starting from a configuration of all elements "off", the controller may perturb a current configuration different M flips (e.g., M<N/2) and then determine a best change in configuration, thereby maintaining improved signals while determining a change in configuration.

In some embodiments, instead of measuring the signal characteristics directly, the signal monitor 103 may listen to or eavesdrop on communications between the transmitter 106 and the receiver 102, and extract signal quality measurements from those communications. For example, the transmitter 102 and the receiver 106 may communicate using a protocol that includes signal quality measurements such as RSSI. In this case, the signal monitor 103 may listen to these transmissions and extract the RSSI (or other) measurements as they are passed between the transmitter 106 and the receiver 102.

Although some embodiments are described in the context of a single receiver and one transmitter, it should be understood that the approach may be applied to provides a best average reception from multiple transmitters to one receiver. That is, the surface may be configured such that the average improvement in channel quality is improved across transmission from different transmitters. Furthermore, it should be understood that the role of transmitter and receiver may be interchanged, such that the surface provide be best improvement in transmissions to one or more receivers. For example, the one transmitter may receive signal strength information from the receivers, e.g., in acknowledgement messages, and pass that information to the signal monitor. In a system in which all communication uses the same frequency channel, configuring the surface for best reception of signal naturally also configures the surface for best reciprocal transmission. In yet other embodiments, there may be multiple transmitters and receivers, and the controller receives signal information from multiple devices and the surface is configured to provide improvement between many different pairs of devices.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

The invention claimed is:

1. A method for determining a deployment configuration of a radio frequency device including a plurality of switchable radio frequency elements disposed on a surface, the method comprising:

configuring the radio frequency device according to a plurality of different configurations including, for each configuration of the plurality of different configurations, switching respective states of multiple switchable radio frequency elements of the plurality of switchable radio frequency elements as specified by said configuration of the plurality of different configurations;

receiving, for each configuration of the plurality of different configurations, feedback characterizing a quality of a transmitted signal received at one or more receivers; and determining, based on the feedback for each configuration of the plurality of different configurations, the deployment configuration of the radio frequency device including determining a deployment state for one or more switchable radio frequency elements of the plurality of switchable radio frequency elements, wherein the determining of the deployment configuration comprises performing, for each switchable radio frequency element of the multiple switchable radio frequency elements, a majority voting algorithm that determines the deployment state for said switchable radio frequency element by voting on the deployment state of said switchable radio frequency element based on the characterized quality of the transmitted signal.

2. The method of claim 1 further comprising applying the deployment configuration to the surface by switching a state of the multiple switchable radio frequency elements to a respective deployment state defined in the deployment configuration.

3. The method of claim 1 wherein switching a state of the multiple switchable radio frequency elements of the plurality of switchable radio frequency elements comprises switching the state into either an on state or an off state.

4. The method of claim 1 where switching a state of each switchable radio frequency element of the plurality of switchable radio frequency elements comprises placing said switchable radio frequency element into a state to reflect, absorb, and/or pass the transmitted signal.

5. The method of claim 1 wherein the one or more switchable radio frequency elements include at least one radio frequency switch and switching a state of the multiple switchable radio frequency elements comprises controlling the at least one radio frequency switch.

6. The method of claim 1 further comprising measuring the quality of the transmitted signal while the radio frequency device is configured according to the plurality of different configurations.

7. The method of claim 1 wherein the quality of the transmitted signal comprises a signal strength measurement, a received signal strength measurement, a bit error rate measurement, a jitter measurement, a noise measurement, a phase measurement, and/or a signal-to-noise measurement.

8. A configurable radio frequency device comprising:

a plurality of switchable radio frequency elements disposed on a surface of the configurable radio frequency device; and a controller communicatively coupled to the plurality of switchable radio frequency elements, the controller configured to:

configure the configurable radio frequency device according to a plurality of different configurations including, for each configuration of the plurality of different configurations, switching respective states of multiple switchable radio frequency elements of the plurality of switchable radio frequency elements as specified by said configuration of the plurality of different configurations;

receive, for each configuration of the plurality of different configurations, feedback characterizing a quality of a transmitted signal received at one or more receivers;

determine, based on the feedback for each configuration of the plurality of different configurations, a deployment configuration of the configurable radio frequency device including determining a deployment state for the multiple switchable radio frequency elements of the plurality of switchable radio frequency elements, wherein determining the deployment configuration includes performing a majority voting algorithm that determines the deployment state for each element of the multiple switchable radio frequency elements by voting on the deployment state based on the characterized quality of the transmitted signal; and apply the deployment configuration to the surface by switching a state of the multiple switchable radio frequency elements to a respective deployment state defined in the deployment configuration.

9. The configurable radio frequency device of claim 8 wherein at least one of the plurality of switchable radio frequency elements can be configured into a state to reflect, absorb, and/or pass the transmitted signal.

10. The configurable radio frequency device of claim 8 wherein at least one of the plurality of switchable radio frequency elements comprises at least one conductor and at least one radio frequency switch.

11. The configurable radio frequency device of claim 8 wherein at least one of the plurality of switchable radio frequency elements consists of least one conductor and of at least one radio frequency switch.

12. The configurable radio frequency device of claim 8 wherein the feedback includes a signal strength measurement, a received signal strength measurement, a bit error rate measurement, a jitter measurement, a noise measurement, and/or a signal-to-noise measurement.

13. A device for modifying radio frequency propagation in an environment, the device comprising:

a plurality of switchable radio frequency elements having conductive sections disposed on a surface of the device, and arranged in a layer, the layer being separated from any other dielectric or conductive layer by at least $\lambda/4$, where $\lambda$ is an expected wavelength of the radio frequency propagation;

wherein each element of the plurality of switchable radio frequency elements comprises one or more switches to selectively couple the conductive sections disposed on the surface of the device, each element being switchable according to a configuration of the one or more switches of the element, different configurations of the one or more switches defining corresponding configurations for the element from a set of configurations, the different configurations of the one or more switches for the element determining corresponding radio frequency propagation characteristics of the element, wherein configuration of the plurality of switchable radio frequency elements of the device determines a radio frequency propagation characteristic in the environment; and a controller communicatively coupled to the plurality of switchable radio frequency elements, the controller configured to:

configure the device according to a plurality of different configurations including, for each configuration of the plurality of different configurations, switching a state of one or more switchable radio frequency elements of the plurality of switchable radio frequency elements as specified by said configuration of the plurality of different configurations, receive, for each configuration of the plurality of different configurations, feedback from one or more receivers, the feedback characterizing a quality of a transmitted signal received at the one or more receivers, and determine, based on the feedback for each configuration of the plurality of different configurations, a deployment configuration of the device including determining a deployment state for each switchable radio frequency element of the plurality of switchable radio frequency elements, including performing a majority voting algorithm that determines the deployment state for each element of the plurality of switchable radio frequency elements by voting on the deployment state based on the characterized quality of the transmitted signal.

14. The device of claim 13 wherein the conductive sections have dimensions of λ/10 by λ/4.

15. The device of claim 13 wherein the controller is wirelessly coupled to the plurality of switchable radio frequency elements.

16. The device of claim 13 wherein at least two switchable radio frequency elements of the plurality of switchable radio frequency elements are disposed on the surface at a distance of at most λ/4 from each other.

17. The method of claim 4, wherein switching the state of said switchable radio frequency element comprises switching the switchable radio frequency element between a state to reflect and a state to pass the transmitted signal.

18. The device of claim 13, wherein a switchable radio frequency element of the plurality of switchable radio frequency elements is not coupled by radio frequency circuit elements to the other switchable radio frequency elements of the plurality of switchable radio frequency elements.

19. The device of claim 13, wherein each switchable radio frequency element of the plurality of switchable radio frequency elements has the same dimensions.

20. The device of claim 16, wherein the plurality of switchable radio frequency elements forms a planar array.

21. The device of claim 16, wherein the plurality of switchable radio frequency elements is dispersed about the environment.

22. The device of claim 13, wherein the plurality of switchable radio frequency elements includes receiving circuitry for wirelessly receiving configuration information for the plurality of switchable radio frequency elements.

23. A method for configuring a surface including a plurality of switchable elements disposed on the surface, wherein each switchable element of the plurality of switchable elements comprises one or more switches configurable into a plurality of different switch configurations, a configuration of switches selects a respective radio frequency characteristic of said switchable element of the plurality of switchable elements from a discrete set of selectable characteristics, the discrete set of selectable characteristics comprising at least two different characteristics from a group of a reflection with a first phase, a reflection with a second phase, propagation through each switchable element of the plurality of switchable elements, and absorption by each switchable element of the plurality of switchable elements, and wherein respective radio frequency characteristics of the plurality of switchable elements together determine an overall radio frequency characteristic of the surface, including a quality of a radio frequency signal emitted from a transmitter, propagated via the surface, and received at a receiver, the method comprising:

generating a plurality of different test surface configurations such that switches of a first subset of the plurality of switchable elements have same settings of switches for all test surface configurations, and such that switches of a second subset of the plurality of switchable elements each has multiple different settings among the plurality of different test surface configurations;

configuring the surface according to the plurality of different test surface configurations including, for each test surface configuration of the plurality of different test surface configurations, setting switches of the plurality of switchable elements as specified by said test surface configuration causing the plurality of switchable elements to have a plurality of respective radio frequency characteristics, the plurality of respective radio frequency characteristics together determining an overall radio frequency characteristic of the surface corresponding to said test surface configuration;

receiving, for each test surface configuration of the plurality of different test surface configurations, feedback characterizing a respective quality of a transmitted signal propagated via the surface and received at one or more receivers with the surface configured according to said test surface configuration; and determining, based on the plurality of different test surface configurations and respective feedback for each test surface configuration of the plurality of different test surface configurations, a deployment configuration of the surface, including determining deployment configurations for the plurality of switchable elements, wherein the determining of the deployment configuration includes determining a setting for a first switch of a switchable element of the second subset of the plurality of switchable elements, including combining the respective qualities of transmitted signals propagated via the surface and received at one or more receivers with the surface configured according to the plurality of different test surface configurations and the setting of the first switch in each of the plurality of different test surface configurations, and the combining, for each test surface configuration of the plurality of different test surface configurations, comprising determining a vote through a majority voting algorithm for a configuration of the first switch for each quality of the respective qualities of transmitted signals propagated via the surface and received at one or more receivers, and the combining further comprising accumulating the votes to determine a deployment configuration for the first switch.

24. The method of claim 23, further comprising repeating steps of generating the plurality of different test surface configurations, configuring the surface, receiving the respective qualities of transmitted signals propagated via the surface, and determining the deployment configuration, varying the second subset of the plurality of switchable elements on different repetitions.

25. The method of claim 24, wherein at each repetition, each step of generating the plurality of different test surface configurations includes determining the first subset and the second subset for use in said repetition, the first and the second subsets differing in at least some repetitions and the first and the second subsets each having multiple switchable elements in at least some repetitions.

26. The method of claim 23, wherein generating the plurality of different test surface configurations comprises generating settings for the one or more switches of each switchable element of the plurality of switchable elements by a pseudo-random process.

27. The method of claim 23, wherein determining the deployment configuration of the surface comprises determining the deployment configuration to be different than any of the plurality of different test surface configurations.

28. The method of claim 23, further comprising transmitting the deployment configuration to the plurality of switchable elements.

29. The method of claim 28, wherein each switchable element of the plurality of switchable elements is wirelessly switchable, and wherein transmitting the deployment configuration includes wirelessly transmitting the deployment configuration to each switchable element of the plurality of switchable elements.

* * * * *